US007173531B2

(12) United States Patent
Chiapperini

(10) Patent No.: US 7,173,531 B2
(45) Date of Patent: Feb. 6, 2007

(54) PERSONAL SAFETY DEVICE

(75) Inventor: Michael Chiapperini, Woburn, MA (US)

(73) Assignee: Michael L Chiapperini, Lynn, MA (US)

( * ) Notice: Subject to any disclaimer, the term of this patent is extended or adjusted under 35 U.S.C. 154(b) by 411 days.

(21) Appl. No.: 10/065,022

(22) Filed: Sep. 11, 2002

(65) Prior Publication Data

US 2004/0046669 A1 Mar. 11, 2004

(51) Int. Cl.
*G08B 23/00* (2006.01)

(52) U.S. Cl. ..... 340/573.1; 340/692; 222/78

(58) Field of Classification Search ..... 340/573.1, 340/574, 692, 384.1, 384.2, 384.73, 338.1, 340/321, 388.1; 222/78, 129
See application file for complete search history.

(56) References Cited

U.S. PATENT DOCUMENTS 4,067,290 A * 1/1978 Hartley ..... 116/99
4,247,844 A * 1/1981 Zapolski et al. ..... 340/321
5,086,377 A * 2/1992 Roberts ..... 362/102
5,088,624 A * 2/1992 Hackett et al. ..... 222/78
5,476,192 A * 12/1995 Julinot ..... 222/78
5,517,180 A * 5/1996 Masi et al. ..... 340/573.1
5,556,003 A * 9/1996 Johnson et al. ..... 222/39
5,635,908 A * 6/1997 Soper ..... 340/574
5,859,588 A * 1/1999 Malone et al. ..... 340/574
5,867,099 A * 2/1999 Keeter ..... 340/567
6,564,969 B1 * 5/2003 Loy ..... 222/78

* cited by examiner

*Primary Examiner*—Phung T. Nguyen
(74) *Attorney, Agent, or Firm*—Gary E. Lambert

(57) ABSTRACT

A personal safety device is provided. The personal safety device is comprised of a housing member, which houses a repellant spray member and a sound generating member. A means well known in the art are used for activation of the repellant spray member, wherein upon activation of the repellant spray member a repellant stored inside of the repellant spray member is released from the repellant spray member. Additionally, means well known in the art are used for activation of the sound generating member, wherein upon activation of the sound generating member a sound, such as a loud alarm, is emitted from the sound generating member. In one preferred embodiment of the invention, the personal safety device has means for activating of either the repellant spray member, or the sound generating member, or both.

17 Claims, 1 Drawing Sheet

PERSONAL SAFETY DEVICE

BACKGROUND OF INVENTION

This invention relates to personal safety devices. Specifically, it relates to devices that can be carried by a person and used to sound an alarm and to ward off an attacker with a spray of a noxious gas.

There are many personal safety devices on the market today. Some of them are whistles, which could be used by the user to alarm others in the vicinity of the danger. Thus, a potential robbery could be averted by a victim's action of sounding the whistle and alarming people on the street of the need to come to the rescue of the victim. However, sounding an alarm may not be enough to avert an attack. Many violent crimes may be committed by attackers who are simply too bold to be scared away by a sound of the alarm.

Other types of personal safety devices are designed to spray an attacker with a noxious gas. Such devices are widely known as pepper sprays or MACE. A noxious gas or mixture of gasses is stored inside of a pressurized container. When the device is activated, the noxious gas escapes the container in a spray which could be directed at a face of an attacker. These devices could be effective in discouraging a would be attacker from committing a crime or in allowing the victim a chance to escape while the attacker is distracted by the effects of the noxious gas sprayed in his face.

However, one of the shortcomings of the noxious spray devices lies in the fact that they do not alarm the attacker of the impending spray defense. Thus, attacker could proceed with the attack and wound or otherwise harm the victim before the victim has a chance to use the spray. It is plausible to assume that some attackers would not proceed with an attack if a loud sound alarm was sounded by the victim prior to use of the spray. Additionally, use of the spray does not alert others in the area of the victim's distress since sprays do not make much noise.

What is needed is a personal safety device designed to be capable of sounding an alarm and, if necessary, of spraying the attacker with a noxious gas. Such device could avert many violent crimes by discouraging attackers with a sound alarm. Furthermore, if the sound alarm does not scare away the attacker, then the victim would have an option to use the noxious gas spray to stop the attacker.

SUMMARY OF INVENTION

This invention is aimed at providing a personal safety device. The personal safety device is comprised of a housing member, which houses a repellant spray member and a sound generating member.

The personal safety device has means well known in the art for activation of the repellant spray member, wherein upon activation of the repellant spray member a repellant stored inside of the repellant spray member is released from the repellant spray member.

Additionally, the personal safety device has means well known in the art for activation of the sound generating member, wherein upon activation of the sound generating member a sound is emitted from the sound generating member. The sound emitted by the sound generating member could be a loud noise or a whistle. The emitted sound could also be sound waves that are audible to animals and not audible to humans to ward off attacking dogs and other attacking animals.

In one preferred embodiment of the invention, a user has a choice of activating either the repellant spray member, or the sound generating member, or both. Any means well known in the art could be used to achieve this goal.

Therefore, it is the object of the present invention to provide a personal safety device to be used in prevention of a physical attack or a robbery.

It is another object of the present invention to provide a personal safety device to be used in warding off of a physical attack or a robbery.

These and other features, aspects and advantages of the present invention will become better understood with reference to the following description, appended claims, and accompanying drawings.

DETAILED DESCRIPTION

Figure 1:
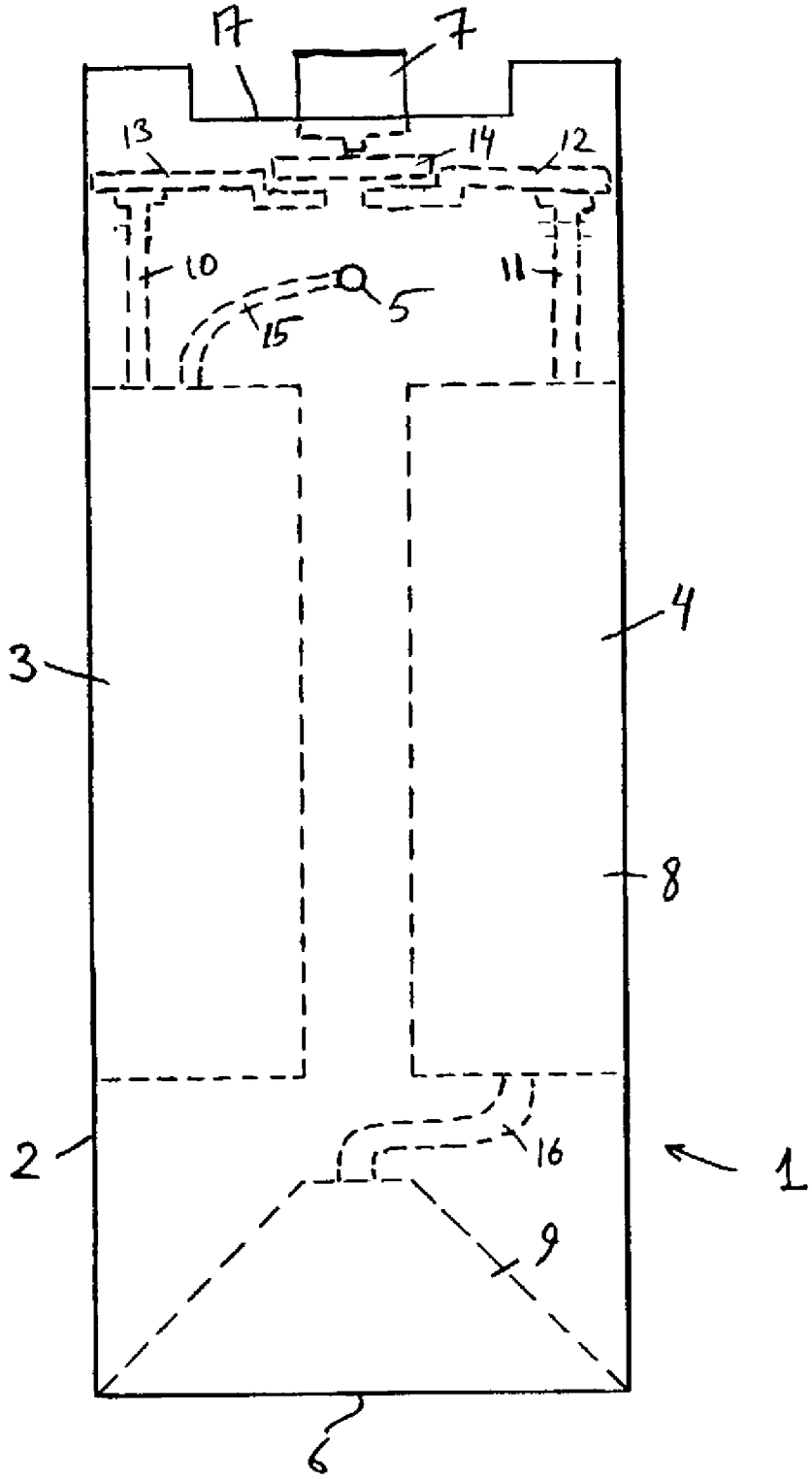
FIG. 1 depicts a front cross-sectional view of one of the embodiments of the personal safety device.

This invention is aimed at providing a personal safety device 1 depicted in cross-section in FIG. 1. The personal safety device 1 is comprised of a housing member 2, which houses a repellant spray member 3 and a sound generating member 4.

The personal safety device 1 has means well known in the art for activation of the repellant spray member 3, wherein upon activation of the repellant spray member 3 a repellant stored inside of the repellant spray member 3 is released from the repellant spray member 3. One possible arrangement for such means is shown in FIG. 1, where upon manual depression of an actuator 7 integrated with the housing member 2, a central actuator pad 14 is depressed, which depresses a repellant actuator pad 13, which in turn depresses a repellant actuator pin 10. The depression of the repellant actuator pin 10 causes the repellant spray member 3 to release the repellant by means well known in the art. The repellant could be a noxious gas or mixture of noxious gasses such as MACE, stored inside of the repellant spray member 3 by means well known in the art. The repellant travels from the repellant spray member 3 into the first tube 15 and exits the housing member 2 via a first aperture 5 located on the housing member 2.

Additionally, the personal safety device 1 has means well known in the art for activation of the sound generating member 4, wherein upon activation of the sound generating member 4 a sound is emitted from the sound generating member 4 by means well known in the art. The sound emitted by the sound generating member 4 could be a loud noise or a whistle. The emitted sound could also be sound waves that are audible to animals and not audible to humans to ward off attacking dogs and other attacking animals.

One possible arrangement for means of activation of the sound generating member 4 is shown in FIG. 1. In this embodiment, the sound generating member 4 is comprised of a compressed gas container 8coupled to a horn 9 via a second tube 16. Upon manual depression of the actuator 7, a central actuator pad 14 is depressed, in turn depressing a sound actuator pad 12, which action in turn depresses a sound actuator pin 11. The depression of the sound actuator pin 11 causes the compressed gas container 8 to release, by means well known in the art, a compressed gas stored inside of it. The compressed gas travels from the compressed gas container 8 into the second tube 16, and enters a horn 9 where a sound is generated by means well known in the art. The sound then exits the housing member 2 via a second aperture 6 located on the housing member 2.

In one preferred embodiment of the invention, a user has a choice of activating either the repellant spray member 3, or the sound generating member 4, or both. Any means well known in the art could be used to achieve this goal. One example of such means is shown in FIG. 1 where the actuator 7 can slide along a top 17 of the housing member 2, thus giving to the user an option of depressing either the repellant actuator pad 13, or the sound actuator pad 12, or the central actuator pad 14. Here, depression of the repellant actuator pad 13 by the actuator 7 results in depression of the repellant actuator pin 10, which action results in activation of the repellant spray member 3. Similarly, depression of the sound actuator pad 12 by the actuator 7 results in depression of the sound actuator pin 11, which action results in activation of the sound generating member 4. Finally, depression of the central actuator pad 14 by the actuator 7 leads to simultaneous depression of both the repellant actuator pad 13 and the sound actuator pad 12, which actions result in simultaneous depression of the repellant actuator pin 10 and the sound actuator pin 11, with the end result of simultaneous activation of both the repellant spray member 3 and the sound generating member 4.

It will be further understood that the embodiments described herein are merely exemplary and that a person skilled in the art may make variations and modifications without departing from the spirit and scope of the invention. All such variations and modifications are intended to be included within the scope of the appended claims.

What is claimed is:

1. A personal safety device comprising:

a housing member, wherein said housing member comprises a design not intended to mask the function of said personal safety device;

a repellant spray member housed inside of the housing member; a sound generating member housed inside of the housing member; means for activation of the repellant spray member, wherein upon activation of the repellant spray member a repellant stored inside of the repellant spray member is released from the repellant spray member; means for activation of the sound generating member, wherein upon activation of the sound generating member a sound is emitted from the sound generating member; and wherein the sound generating member has means for emitting sound waves that are audible to animals and not audible to humans.

2. The personal safety device of claim 1 wherein: the housing member has a first aperture for allowing release from the housing member of the repellant when the repellant spray member is activated.

3. The personal safety device of claim 1 wherein: the housing member has a second aperture for allowing emission from the housing member of the sound when the sound generating member is activated.

4. The personal safety device of claim 1 further comprising: means for simultaneous activation of the repellant spray member and the sound generating member.

5. The personal safety device of claim 1 further comprising: an actuator, integrated with the housing member, wherein the actuator has means for selectively activating the repellant spray member.

6. The personal safety device of claim 1 further comprising: an actuator, integrated with the housing member, wherein the actuator has means for selectively activating the sound generating member.

7. The personal safety device of claim 1 further comprising: an actuator, integrated with the housing member, wherein the actuator has means for simultaneous activation of the repellant spray member and the sound generating member.

8. The personal safety device of claim 1 wherein: the repellant is a noxious gas.

9. The personal safety device of claim 1 wherein: the repellant is a mixture of noxious gases.

10. The personal safety device of claim 1 wherein: the sound generating member is comprised of a compressed gas container coupled to a horn.

11. The personal safety device of claim 1 wherein: the sound generating member is comprised of a compressed gas container coupled to a whistle.

12. A personal safety device comprising: a housing member, wherein said housing member comprises a design not intended to mask the function of said personal safety device, and wherein said housing member includes a first aperture and a second aperture; a repellant spray member housed inside of the housing member; a sound generating member housed inside of the housing member; an actuator, integrated with the housing member, wherein the actuator has: means for activation of the repellant spray member, wherein upon activation of the repellant spray member a repellant stored inside of the repellant spray member is released from the repellant spray member, and further released from the housing member via the first aperture; means for activation of the sound generating member, wherein upon activation of the sound generating member a sound is emitted from the sound generating member, and further release from the housing member via the second aperture; and wherein the sound generating member has means for emitting sound waves that are audible to animals and not audible to humans.

13. The personal safety device of claim 12 wherein: an actuator has means for simultaneous activation of the repellant spray member and the sound generating member.

14. The personal safety device of claim 12 wherein: the repellant is a noxious gas.

15. The personal safety device of claim 12 wherein: the repellant is a mixture of noxious gases.

16. The personal safety device of claim 12 wherein: the sound generating member is comprised of a compressed gas container coupled to a horn.

17. The personal safety device of claim 12 wherein: the sound generating member is comprised of a compressed gas container coupled to a whistle.

* * * * *